US009745806B2

(12) United States Patent
Jelgert et al.

(10) Patent No.: US 9,745,806 B2
(45) Date of Patent: Aug. 29, 2017

(54) DRILL ROD GRIPPING APPARATUS

(71) Applicant: SANDVIK INTELLECTUAL PROPERTY AB, Sandviken (SE)

(72) Inventors: Johan Jelgert, Lindesberg (SE); Lars-Erik Larsson, Nora (SE); Krister B Eriksson, Nora (SE); Ola Fredin, Nora (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/891,456

(22) PCT Filed: Apr. 9, 2014

(86) PCT No.: PCT/EP2014/057176
§ 371 (c)(1),
(2) Date: Nov. 16, 2015

(87) PCT Pub. No.: WO2014/183933
PCT Pub. Date: Nov. 20, 2014

(65) Prior Publication Data

US 2016/0115750 A1 Apr. 28, 2016

(30) Foreign Application Priority Data

May 17, 2013 (EP) ..... 13168292

(51) Int. Cl.
*E21B 19/16* (2006.01)
*E21B 7/02* (2006.01)
*E21B 19/20* (2006.01)

(52) U.S. Cl.
CPC ..... *E21B 19/161* (2013.01); *E21B 7/02* (2013.01); *E21B 19/164* (2013.01); *E21B 19/168* (2013.01); *E21B 19/20* (2013.01)

(58) Field of Classification Search
CPC ..... E21B 19/161; E21B 7/02; E21B 19/20; E21B 19/164
See application file for complete search history.

(56) References Cited

U.S. PATENT DOCUMENTS

| | | | | |
|---|---|---|---|---|
| 3,043,619 | A | 7/1962 | George et al. | |
| 5,221,099 | A | 6/1993 | Jansch | |
| 6,550,128 | B1 | 4/2003 | Lorenz | |
| 7,036,397 | B2 * | 5/2006 | Bangert | E21B 19/07 81/57.15 |
| 2005/0018879 | A1 | 1/2005 | Ito et al. | |
| 2011/0030512 | A1 | 2/2011 | Begnaud | |

FOREIGN PATENT DOCUMENTS

| | | | |
|---|---|---|---|
| CA | 2459628 | A1 | 8/2004 |
| WO | 00/65193 | A1 | 11/2000 |
| WO | 2011/129760 | A2 | 10/2011 |
| WO | 2012/162617 | A2 | 11/2012 |

* cited by examiner

*Primary Examiner* — Giovanna C Wright
*Assistant Examiner* — Manuel C Portocarrero
(74) *Attorney, Agent, or Firm* — Corinne R. Gorski

(57) ABSTRACT

A drill rod gripping apparatus to grip and impart rotational motion to a drill rod including a sled axially mounted at a frame and having first and second jaws moveably mounted at the sled to allow a substantially linear lateral movement across the sled to and from one another. A plurality of rod engagers are mounted at each jaw with at least one of the engagers including an abrasive surface formed from a coating to increase the frictional force between the drill rod and the gripping apparatus.

14 Claims, 8 Drawing Sheets

DRILL ROD GRIPPING APPARATUS

RELATED APPLICATION DATA

This application is a §371 National Stage Application of PCT International Application No. PCT/EP2014/057176 filed Apr. 9, 2014 claiming priority of EP Application No. 13168292.4, filed May 17, 2013.

FIELD OF INVENTION

The present invention relates to drill rod gripping apparatus and a drill rig to feed rods to and from a drill string and in particular, although not exclusively, to gripping apparatus having at least one rod engager with an abrasive surface to increase the frictional force between the drill rod and the gripping apparatus.

BACKGROUND ART

Exploration drilling typically involves drilling to subterranean depths of thousands of meters. Accordingly, it is necessary to join and install successive sections of pipe or rod as the drill string is advanced into the well.

Drill rods, depending on their specific configuration, may weigh between ten to fifty kilograms each and measure approximately two to three meters in length. Conventionally, the drill rods are interconnected by male and female threaded connections provided at the respective rod ends. Additionally, it is typically unavoidable to have to exchange the drill bit or other tools at the lowermost end of the drill string at regular intervals during drilling. This exchange process involves retrieving the entire string from the borehole, exchanging the lowermost portion and then reinstalling the entire string after which drilling may continue. In practice, and depending upon rock conditions, it is not uncommon for ten to twenty retrieval operations to be undertaken per drill hole. Accordingly, a very large number of drill rods are required to be handled and in particular taken from a transport or storage carriage to the drilling rig where they are ready for axial alignment and coupling to the drill string. Of course, the reverse operation is also required during string retrieval. Example rod handling systems are described in U.S. Pat. No. 3,043,619; GB 2334270; WO 00/65193; and WO 2011/129760.

A rod handling system may typically comprise a robotic arm having a dedicated gripper for gripping the drill rods. During a forward drilling operation, the robotic arm is arranged to pick-up drill rods at a transport or intermediate carrier and to place the drill rod in the drill rig, whereupon the drill rod is connected to an already installed drill rod to extend the string. During a string retrieval operation, the robotic arm is arranged to pick up disconnected rods from the drill rig and to replace them onto the transport or intermediate carrier.

In order to provide a fully automatic system, that eliminates the need for regular manual intervention, it is desirable for the rod handling system to be able to connect and disconnect the drill rod to/from the installed drill rods. Typically, an end rod of the drill string is engaged by an aft located gripper unit having one or a plurality of rod engagers at least one of which is configured to apply a torque force to the rod via frictional contact with the outside surface of the rod. The remaining rods of the drill string are held by a rod holder at a forward position on the rig. It is advantageous to increase the frictional contact between the rod engagers and the rod so as to ensure the rod is held firmly and a sufficient amount of drive can be translated to impart the rotational movement to the rod. A number of attempts have been made to try and improve the frictional contact between a gripper unit and a rod and examples are disclosed in U.S. Pat. No. 5,221,099; CA 2459628 and US 2005/0188793. However, conventional rod engagers are typically designed for use with a rod of specific and pre-determined diameter and/or are not configured to impart rotational drive to the rod but to grip and hold the rod only. Accordingly, existing attempts either exhibit non-uniform performance when used with rods of different diameter or are incompatible with a gripper unit configured for rod makeup or breakout operations. Accordingly, what is required is rod gripping apparatus that addresses these problems.

SUMMARY OF THE INVENTION

It is an objective of the present invention to provide makeup and breakout gripping apparatus and in particular a drill rig configured for use in feeding drill rods to and from the rig so as to effectively grip the rod to allow axial movement and to impart rotational drive to the rod or rods of varying external diameter. It is also a specific objective to provide a gripping unit having a plurality of rod engagers where at least one of the engagers is configured to be maintained in touching contact with the rod and to effectively and efficiently conduct translational drive to the rod with no or minimal loss in frictional contact with the rod external surface.

The objectives are achieved by providing a gripper unit having a frame that mounts an axially slidable sled having a pair of jaws capable of linear lateral movement to and from one another and about the external surface of the rod. Optimised frictional contact is achieved between the rod and jaw mounted rod engagers by providing at least one of the engagers with an abrasive, high friction surface. The inventors have observed that an engaging jaw arrangement in which the jaws move perpendicular or transverse to the longitudinal axis via a lateral sliding motion (being distinct from a pivoting action) is advantageous in that the axial centre of the cooperating engagers (mounted at each jaw) is constant for a plurality of drill rods having different external rod diameters. By configuring the jaws and the engagers to be operative to move to and from a common central axis (being independent of rod diameter) the frictional contact between the engagers and the rod external surface can be optimised via at least one of the engagers comprising an abrasive surface.

According to a first aspect of the present invention there is provided drill rod gripping apparatus to grip and impart rotational motion to a drill rod comprising: a frame having a front end and a rear end spaced apart from the front end in a direction of a longitudinal axis corresponding to an axis of a drill rod when mounted at the apparatus; a sled mounted at the frame via at least one support configured to allow axial movement of the sled relative to the frame; a first and second jaw mounted at the sled via respective mounts to allow substantially linear lateral movement of the first and second jaws to and from each other across the sled in a direction transverse or perpendicular to the longitudinal axis; a plurality of rod engagers mounted at each of the first and second jaws, at least one of the engagers being rotatably driven by a drive actuator; wherein at least one of the rod engagers comprises an abrasive surface to increase the frictional force between the drill rod and the at least one rod engager.

Reference within this specification to an 'abrasive surface' encompasses a surface and surface coating offering a high friction coefficient preferably provided by embedded granular particulates at the surface and/or coating. The granular particulates comprise generally a material that is harder than the underlying base or substrate material of the engager and/or coating in which the granular particles are embedded. The abrasive surface is configured to increase the friction force between the engagers and the rod whilst minimising surface marking, scoring, scratching or damaging the rod due to contact. The present coating is therefore generally harder than the underlying material of the engager body or substrate.

Preferably, the at least one support comprises a pair of elongate runners mounted at and extending between the front end and rear end of the frame, optionally in the form of shafts extending axially either side and/or above the sled.

Preferably, the respective mounts comprise tong and groove arrangements. Optionally, the lateral side-to-side movement of the jaws may be provided by any linear operating mechanism including cables, pulleys, belts, runners, hook and channel arrangements, screw threads arrangements (threaded rod and sleeve), mechanical, pneumatic, hydraulic or magnetic based translational movement mechanisms. Preferably, the apparatus further comprises a drive mechanism to drive the lateral movement of the first and second jaws in the transverse or perpendicular direction relative to the longitudinal axis, the drive mechanism comprising a drive actuator. Preferably, the drive actuator is a hydraulic or pneumatic cylinder. Optionally, the drive actuator may be an electric motor. Preferably, the drive mechanism comprises a rack and pinion arrangement driven by the drive actuator.

Preferably, the apparatus further comprises an actuator arm pivotally mounted at one end to the frame and at an opposite end to a feed frame of a drill rig.

Preferably, the apparatus further comprises a respective drive actuator mounted at the first and second jaw to drive at least one engager at each respective first and second jaw.

Preferably, the abrasive surface is formed as a high hardness coating at the at least one engager. Preferably, the coating comprises granular particles embedded in the coating, the particles having a hardness being greater than the coating and/or the underlying material of the engager. Optionally, the granular particles may comprise any one or a combination of the following set of: diamond; silicon; zircon; tungsten; a carbide; tungsten carbide carborundum; cubic boron nitride; diamond; glass; a ceramic; corundum; quartz; titanium; a polycrystalline diamond composite; natural diamond.

Optionally, the granular particles may comprise an average particle diameter of between 200 to 800 μm. Optionally, the abrasive surface may comprise a P-grade of between P24 to P60 according to the European Federation of European Producers of Abrasives (FEPA) international standard.

Preferably, the engagers comprise two rollers mounted respectively at each of the first and second jaws. Preferably, the rollers are formed as cylinders rotatably mounted upon axles. Optionally, the cylinders comprise an axial length between 100 to 200 mm. Preferably, the abrasive surface is provided at the two rollers mounted at either of the first or second jaws.

According to a second aspect of the present invention there is provided a drill rig to feed rods to and from a drill string comprising: a feed frame; a rotation unit mounted at the feed frame to provide rotational drive to the drill string; a rod holder to mount an end region of the drill string; gripping apparatus as claimed herein; and a transporter mounting the gripping apparatus to the feed frame to transport the gripping apparatus from a rod collection position to a rod coupling position at the drill rig such that a rod is aligned axially with the drill string at the rod coupling position.

Preferably, the rod holder is mounted at a support frame optionally positioned parallel to the main feed frame of the drill rig.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

The present apparatus is configured to provide automated feeding of drill rods to and from a drill string at a drill rig. Specifically, embodiments of the present invention relates to apparatus and method for improving drill string drive and extraction operations. In particular, a gripping unit is configured to exert a torque onto a tubular element such as a drill rod to makeup or breakout a threaded connection between the drill rods connected together to form a drill string. The present coupling apparatus comprises mechanical and specifically hydraulic components to provide a robust configuration given the rough working environment in which the apparatus is operational. The present gripping unit is specifically configured to maximise the transfer of rotational drive (imparted by rod engagers mounted at the gripper unit) to the final rod of the drill string during makeup or breakout of the threaded connections.

Figure 1:
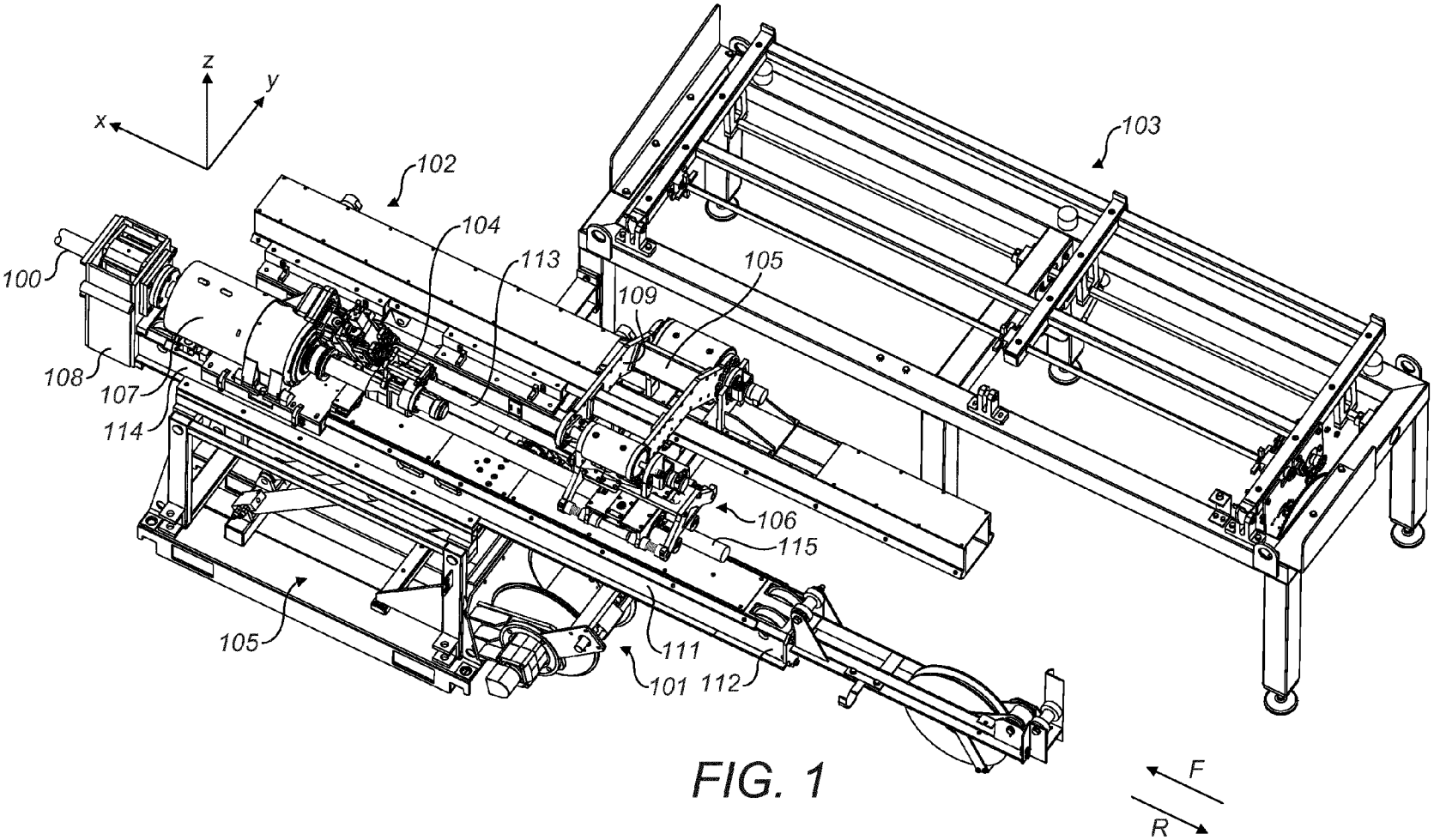
FIG. 1 is an upper perspective view of drill rig, a rod storage rack and rod handling apparatus positioned intermediate the drill rig and rack according to a specific implementation of the present invention.

Referring to FIG. 1, a drill rig 101 comprises a feed frame 111 having a first forward end 114 and a second rearward end 112 relative to a drill string 100. A rod holder 108 is mounted at first end 114 and is configured to hold an end rod 100 of the drill string that typically extends in a downward direction within a deep borehole. A rotation unit 107 is mounted behind holder 108 at frame 111 and comprises conventional components configured to rotate the drill string rods 100 during a drilling procedure. Feed frame 111 is mounted upon a ramp assembly 105 configured to adjust the drilling angle of rig 101. As illustrated, the drill string 100 extends in the x axis in which a rod drilling operation involves rotational advancement of the drill rods 100 in direction F whilst retraction of the rods from the borehole is undertaken in the opposite direction R both in the x axis.

Figure 2:
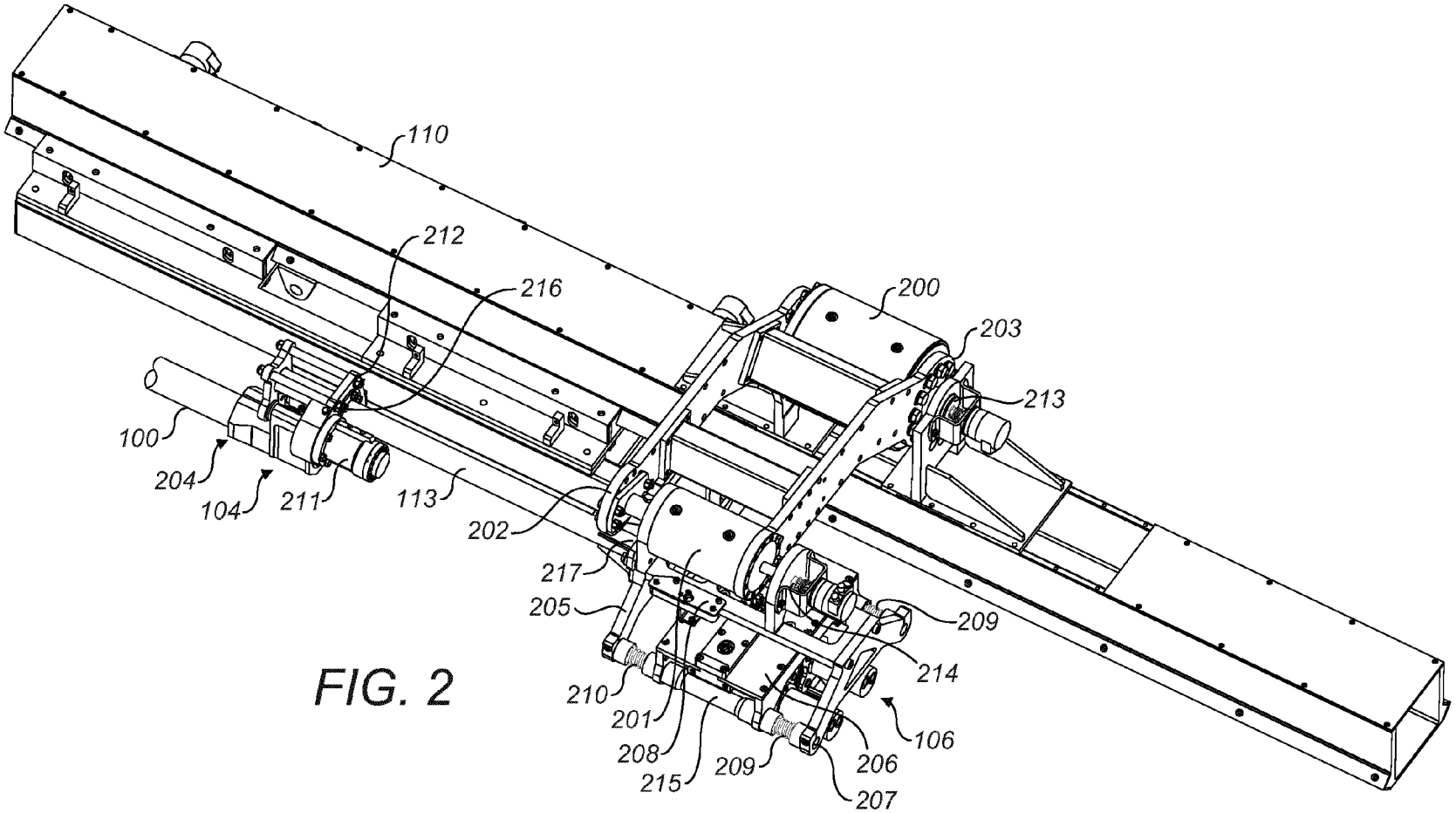
FIG. 2 is a first side perspective view of the rod handling apparatus of FIG. 1.

Rods to be supplied to drill rig 101 are transported and stored temporarily on a rod storage rack 103 positioned adjacent rig 101. Rod handling apparatus indicated generally by reference 102 is positioned intermediate rack 103 and rig 101 and is configured to transport rods between rack 103 and rig 101 during any drilling and retraction procedure. Referring to FIGS. 1 and 2, rod handling apparatus 102 comprises a guide frame 110 that mounts a transport unit in the form of a robotic arm 109 pivotally mounted at both its ends. A gripper unit 106 is mounted at one end of arm 109 and is configured to engage and hold rods to be transported between rack 103 and rig 101. To ensure rods are coupled efficiently and to avoid misalignment and damage during coupling, rod handling apparatus 102 further comprises an alignment tool 104 intended to engage an end rod of the drill string 100 and to mate the drill string with a 'transported' rod taken from rack 103.

Figure 3:
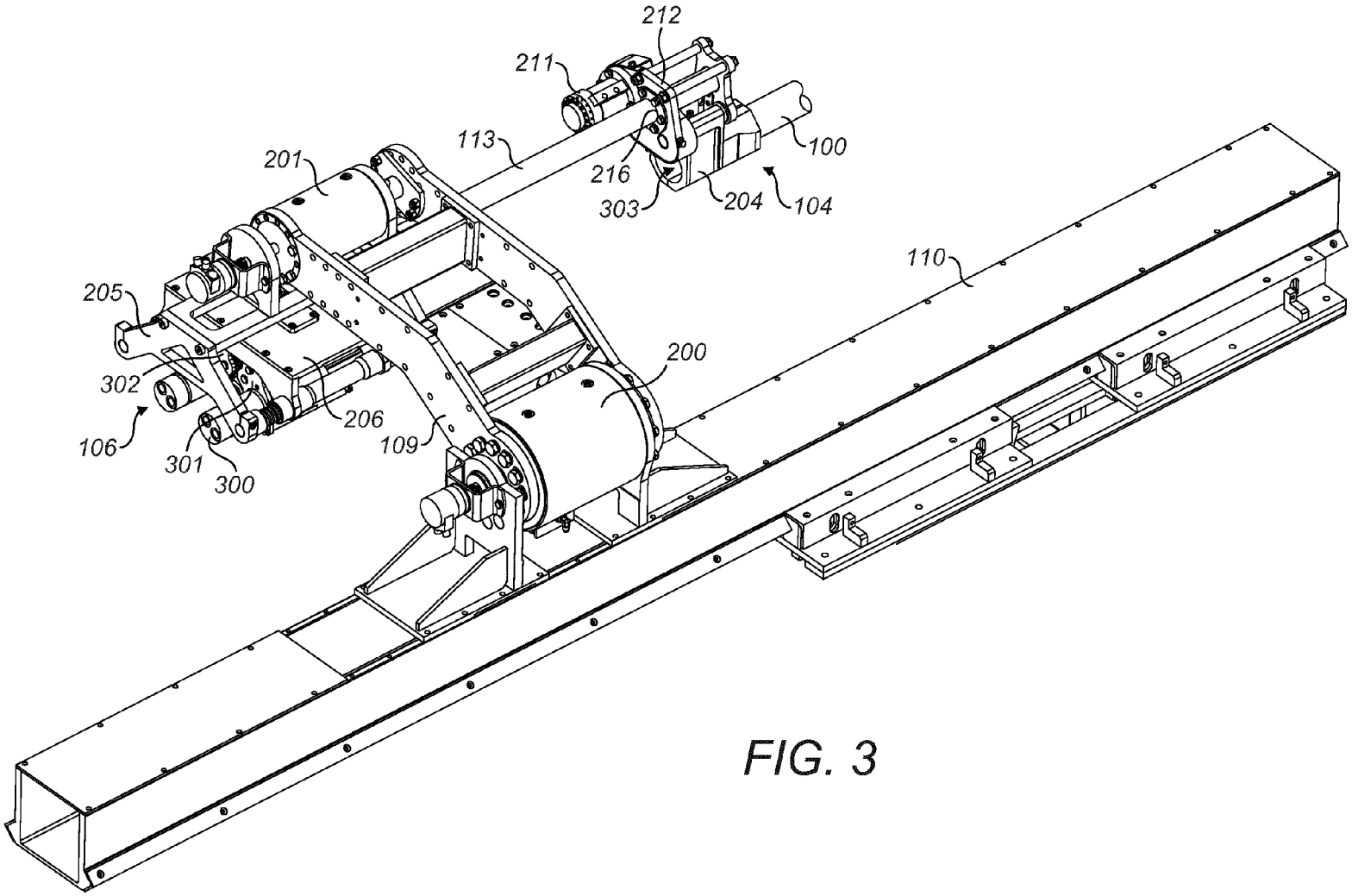
FIG. 3 is a second side perspective view of the rod gripping apparatus of FIG. 2.
Figure 4:
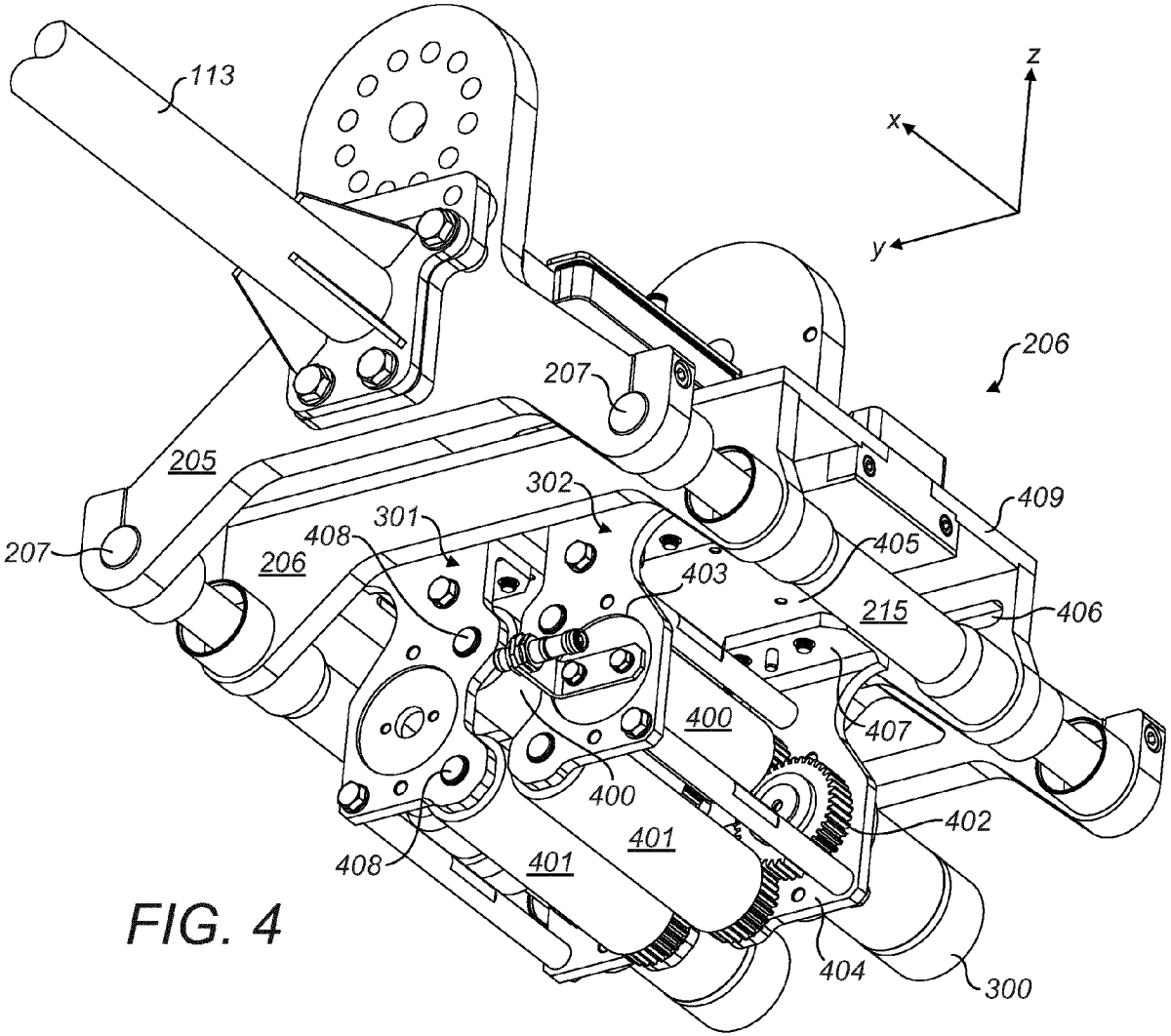
FIG. 4 is a lower perspective view of a rear part of the rod gripping apparatus of FIG. 3.

Referring to FIGS. 2 to 4 actuating arm 109 is mounted at a first end 203 to guide frame 110 via an actuator 200 (being typically a hydraulic, pneumatic or electric motor) to provide pivoting rotation of arm 109 about a pivot axis 213. Gripper unit 106 is mounted at a second end 202 of arm 109. A corresponding actuator 201 is positioned at end 202 to drive rotational mounting of gripper unit 106 at arm 109 to be rotatable about a pivot axis 214. Additionally, drive and movement means (not shown) are provided such that arm 109 is capable of linear translation along the direction of frame 110 to adjust the relative position of the rod during transport to rig 101 in the x axis direction both during coupling and decoupling operations. Via the pivoting mounting of gripper unit 106 at frame 110 (via arm 109), and the axial movement means (not shown) gripper unit 106 is configured for movement in the x, y and z directions during rod transport.

Gripper unit 106 comprises a support frame 205 mounted to arm 109 and a movable sled 206 capable of shuttling back and forth with respect to frame 205 in the F and R directions during rod coupling and decoupling operations. In particular, gripper unit 106 comprises a pair of parallel shafts 207 that extend lengthwise in the x axis direction between a forward and rearward part of frame 205, a forward most side of frame 205 being positioned closest to the drill string 100 (and holder 108 and rotation unit 107). Sled 206 comprises a pair of sleeves 215 configured to slide over respectively each shaft 207 such that sled 206 is suspended in a 'floating' relationship with respect to frame 205. A first pair of rearward bias springs 209 are mounted at a rearward end of each shaft 207 and a corresponding pair of forward mounted bias springs 210 are positioned at a forward end of each shaft 207 axially either end of each sleeve 215. Accordingly, forward springs 210 provide biasing resistance to forward movement of sled 206 in direction F and rearward springs 209 provide resistance to axial movement of sled 206 in reverse direction R.

Gripper unit 106 further comprises a motion tracking sensor arrangement indicated generally by reference 208 mounted at a region of frame 205 and sled 206. Accordingly, a relative axial position of sled 206 (in the x axis direction) relative to frame 205 may be monitored by sensor unit 208.

Elongate beam 113 comprises a first end 216 rigidly mounted at alignment tool 104 and a second end 217 rigidly mounted a region of gripper frame 205. Beam 113 comprises a physical and mechanical configuration and in particular an outside diameter configured to allow alignment tool 104 to deflect laterally in the y and z plane during coupling of the rods in direction F. Alignment tool 104 comprises a pair of moveable jaws 204 pivotally mounted at a support frame 212 a region of which is coupled directly with beam end 216. An actuator 211 (typically a hydraulic, pneumatic or an electric motor) is mounted at frame 212 to drive pivoting displacement of jaws 204 in the y and z plane. In a 'closed' state jaws 204 define an internal coupling chamber 303 into which are received the end portions of the respective end rod 100 of the drill string and rod 115 to be added to the end of the drill string and carried with gripper unit 106.

Gripper unit 106 comprises a pair of opposed rod engagers in the form of gripper jaws 301, 302. Each jaw 301, 302 is capable of movement in a sideways lateral direction away from the x axis corresponding generally to a linear movement in the perpendicular y axis direction. Referring to FIG. 4, the two opposed jaws 301, 302 project generally in a downward direction from sled 206 so as to represent an undercarriage of the gripper unit 106. Each jaw 300, 301 comprises a respective pair of rod engagers in the form of elongate rollers configured for frictional contact onto the external surface of rod 115. Each pair of rollers 400, 401 is aligned parallel with the longitudinal axis of rod 115 and the x axis. A first roller 400 is positioned vertically above a second roller 401 and at an inward position of each jaw 301, 302 such that the four rollers 400, 401 form a quad assembly to surround rod 115 that is engaged and gripped between the opposed pair of rollers 400, 401.

Each jaw 301, 302 comprises a respective actuator 300 (being hydraulic, pneumatic or electric motors) mounted at a rearward end of each jaw 301, 302. Each actuator 300 is capable of providing rotational drive to at least one roller 400, 401, via gears 402 mounted on respective drive shafts (not shown) of each actuator 300, so as to impart rotation of rod 115 about its longitudinal axis.

Figure 5:
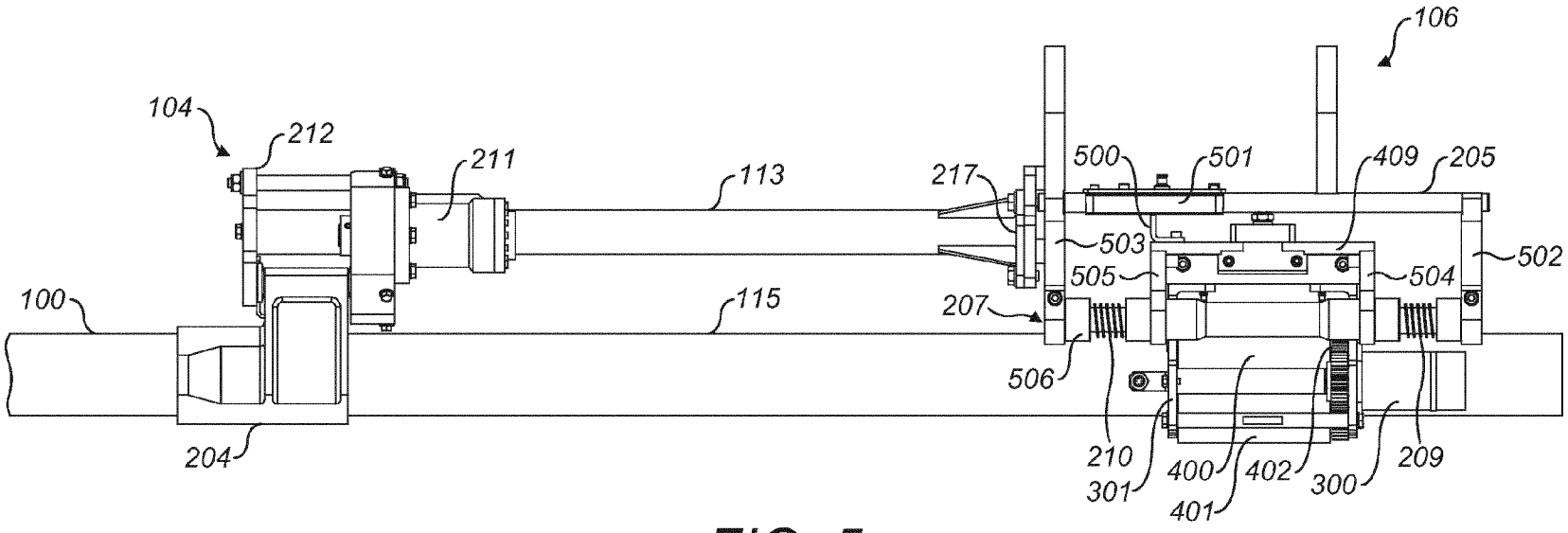
FIG. 5 is a side elevation view of the rod gripping apparatus of FIG. 3 engaging a rod to be coupled to a drill string.

Referring to FIG. 5, motion sensor 208 is adapted to monitor the relative axial position (in the x axis direction) of sled 206 relative to frame 205. This is achieved via a first sensor part 500 mounted at a region of sled 206 and a second sensor part 501 mounted at frame 205. As rod 115 is gripped substantially rigidly by sled 206, any axial movement of rod 115 relative to frame 205 is determined by the length displacement sensor unit 500, 501. Such a sensor arrangement and its relative mounting position is useful both in the coupling (makeup) and decoupling (breakout) operations to provide feedback signals to the automated control unit (not shown) and to identify a correct coupling and decoupling of rod 115 at string 100. In particular, sensor arrangement 500, 501 is configured to determine the relative axial displacement of sled 206 having forward end plate 505 and rearward end plate 504 relative to frame 205 having forward end 503 and rearward end 502.

Figure 7:
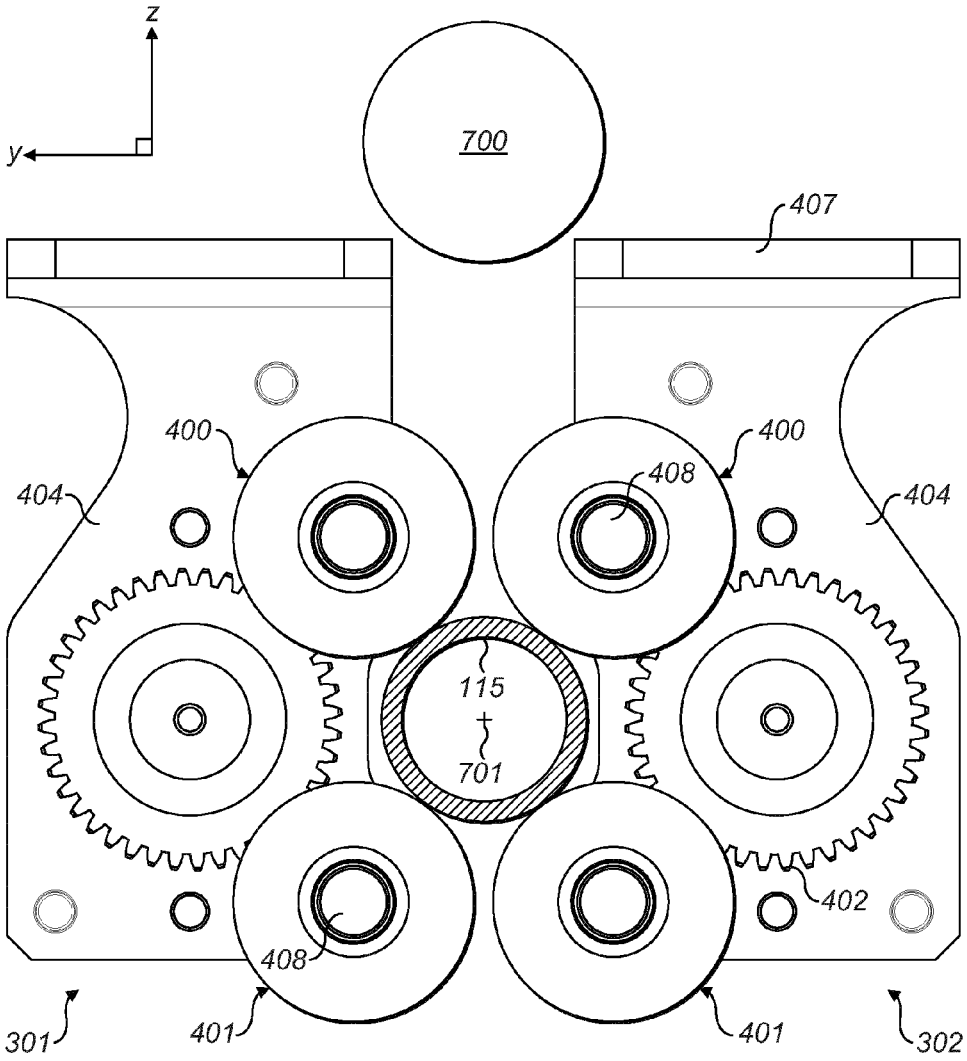
FIG. 7 is a front end view of the gripper unit of FIG. 4 with certain components removed for illustrative purposes.

The function of alignment tool 104 is twofold. Firstly, a primary function is to provide guided coupling between rods 100 and 115 whilst a secondary function is to provide additional support for rod 115 during the transport between rack 103 and rig 101. As the collection of rod 115 from rack 103 typically involves the gripper unit 106 approaching rod 115 from above in the z axis direction, the alignment tool 104 must similarly comprise a jaw arrangement (corresponding to gripper jaws 301, 302) to allow rod 115 to be engaged by both units 104, 106 simultaneously. Accordingly, alignment tool jaw actuator 211 is synchronised with a gripper jaw actuator 700 (referring to FIGS. 7 and 8) such that the opening and closing of the alignment jaws 204 occurs simultaneously with a corresponding opening and closing of the gripper jaws 301, 302.

Figure 6:
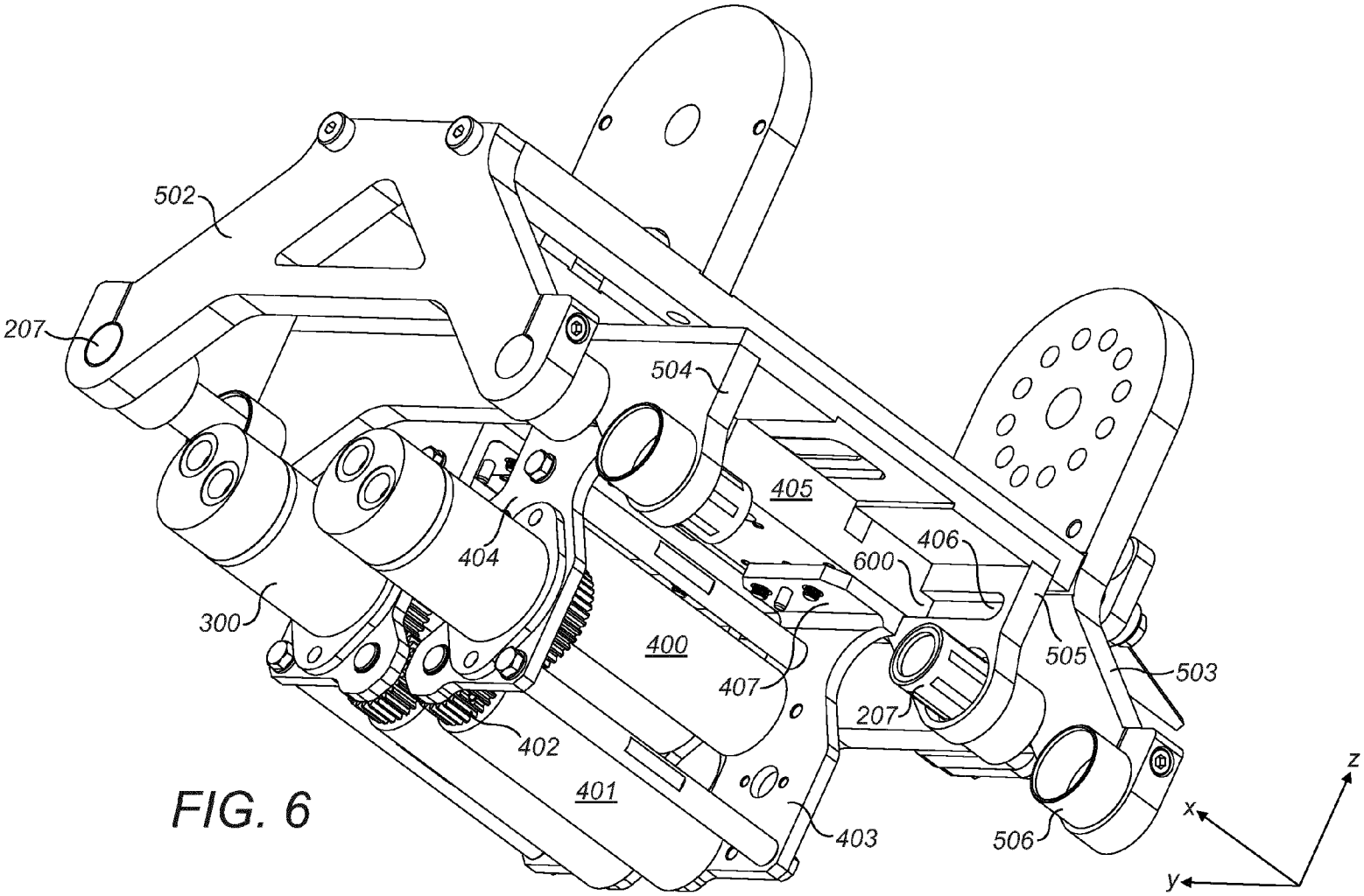
FIG. 6 is a magnified lower perspective view of the gripper unit of FIG. 4 from the rear with certain components removed for illustrative purposes.

Referring to FIGS. 4 to 6, sled 206 comprises a mounting plate 409 that provides a bridge to connect the forward end plate 505 and rearward end plate 504. A pair of grooves 406 are indented on an internal facing side of each end plate 505, 504 to be positioned opposed and parallel to another immediately below plate 409. That is, grooves 406 extend in the y axis being perpendicular to the longitudinal axis x and the corresponding longitudinal axis of rod 115 and string 100.

Each jaw 301, 302 comprises a forward mount 403 positioned towards forward end plate 505 and a rearward mount 404 positioned towards rearward end plate 504. Both the upper 400 and lower 401 rollers are mounted upon axles 408 that extend in the x axis direction between forward and rearward mounts 403, 404. Each mount 403, 404 of each jaw terminates at its uppermost end by a mounting block 407 secured to an underside of a respective actuator unit 405 mounted below support plate 409. A respective forward and rearward end of each unit 405 comprises an elongate tongue 600 extending in the y axis direction and accommodated respectively within the forward and rearward grooves 406 of each end plate 505, 504. One or both units 405 comprises a drive mechanism configured to drive a linear lateral movement of each unit 405 in the y axis direction relative to sled plates 409, 505, 504. That is, each jaw 301, 302 is mounted at its upper end via a respective actuator unit 405 having at least a portion slidably mounted within grooves 406 such that jaws 301, 302 (and rollers 400, 401) are configured to move in a linear side-by-side sliding motion so as to engage rod 115 from either side perpendicular to longitudinal axis x. According to the specific implementation, units 405 are associated with a drive actuator 700 (referring to FIGS. 7 and 8) operative to control and drive a pinion of a rack and pinion type linear actuator mounted at the region of units 405. As will be appreciated, any drive mechanism known in the art is suitable and compatible for use with the present invention so as to provide the sideways linear movement of jaws 301, 302 such that each roller 400, 401 moves in a respective single plane. Accordingly, the four rollers 400, 401 are configured to always centre at a central (rod) axis 701 such that central axis 701 is common to rods of different external diameter.

Figure 8:
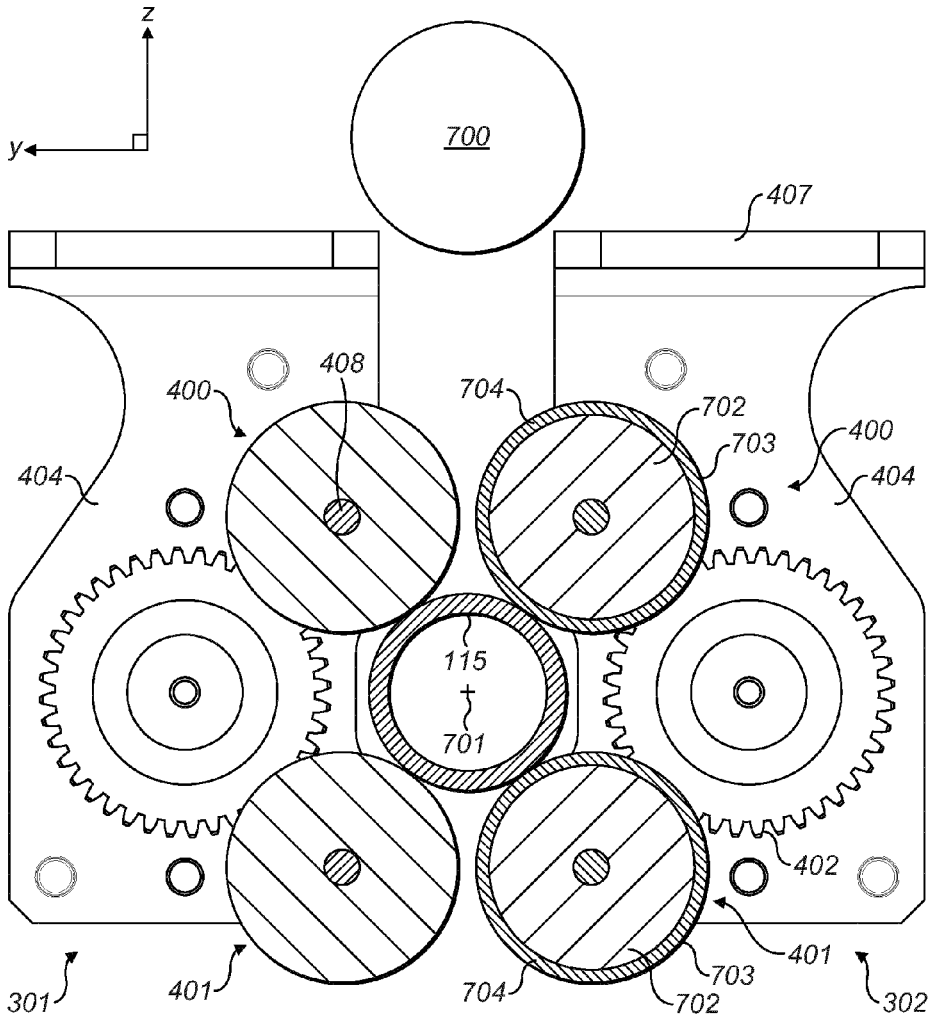
FIG. 8 is a cross sectional front end view through the gripper unit of FIG. 4 with certain components removed for illustrative purposes.

Referring to FIG. 8, both the upper 400 and lower 401 rollers of each jaw set 301, 302 comprises a main body 702 having a generally cylindrical configuration amounted about respective axles 408. According to the specific implementation, both the upper and lower rollers 400, 401 of jaw 302 comprise a grit-based surface coating 704 configured to provide a high friction surface 703 to enhance the frictional force with rod 115 positioned at a central axis 701. Accordingly, the rollers 400, 401 of the alternate jaw 301 are devoid of a grit-embedded, high-friction surface coating. As will be appreciated, the function of the surface treated rollers 400, 401 is to transfer an amount of torque to rod 115 such that rod 115 may be rotated relative to the drill string 100 so as to breakout the threaded connection between rod 115 and the last rod of the string 100. The frictional demand between rollers 400, 401 and rod 115 are variable and are dependent upon rod diameter, tilt/drilling angle and any surface contaminants such as oil at the external surface of rod 115. To optimize the frictional contact between rollers 400, 401 and rod 115, surface 703 is configured as an abrasive surface with a coarseness level sufficient to carry the required frictional force whilst being fine enough not to unnecessarily mark the outer surface of rod 115.

Surface coating 704 comprises an elastomeric or polymeric base layer. Alternatively, the base layer may comprise a malleable metal such as copper. Optionally, an intermediate adhesive layer or substrate tape is applied to main body 702 optionally using an adhesive or binder material. A granular particulate is embedded in the substrate or base layer to provide engaging rollers 400, 401 (of jaw 302) with a coarse surface finish formed by the grains or particles of relatively small diameter. As will be appreciated, the abrading particles may comprise a metal, a hard plastic, a ceramic, a glass, a carbide and/or diamond. According to specific embodiments, the abrading particles may comprise: emery; aluminium oxide; silicon carbide; tungsten carbide, alumina zirconia; chromium (III) oxide; a ceramic oxide; silicon; zircon; tungsten; carborundum; cubic boron nitride; corundum; quartz particles or grains; titanium; a polycrystalline diamond composite; natural diamond and mixtures thereof.

According to the specific implementation, each roller 400, 401 comprises diamond particles to provide a surface coarseness of between P24 to P60 according to the European Federation of European Producers of Abrasives (FEPA) P-grade system. According to the specific implementation, an average particle diameter of the abrasive grains is between 770 μm to 260 μm. Moreover, and according to the specific implementation, the coarseness level, referring to the grit size, is approximately 500 μm+/−300 μm.

According to further specific embodiments, only one of the four rollers 400, 401 comprises the surface coating 704. According to a yet further embodiment, both rollers 400, 401 of both jaws 301, 302 comprise the surface coating 704. Accordingly, one or a plurality of the rod engaging rollers 400, 401 may comprise a higher friction coefficient relative to other rollers 400, 401 of the respective jaws 301, 302.

According to the specific implementation, an axial length of rollers 400, 401 in the x axis direction is 150 mm+/−50 mm. Additionally, a centre-to-centre distance of rollers 400, 401 of each jaw 301, 302 is between 60 to 80 mm where rollers 400, 401 comprise an outside diameter of 50 mm.

According to the specific implementation, jaws 301, 302 are moved laterally in the x-y plane across the width of the sled 206 in a direction perpendicular to the longitudinal axis of rod 115. Rod 115 is contacted by each of the four rollers 400, 401 with at least one of these rollers driven by actuator 300 so as to impart the rotational drive to either makeup or breakout the threaded connection between rod 115 and string 100. According to further specific implementations rod engagers 400, 401 may comprise belts, coated belts or chain segments to engage onto the external surface of rod 115 and to be driven by suitable actuators 300. The high friction coarse surface coating on engagers 400, 401 is configured to facilitate gripping of rod 115 to allow both secure axial displacement (in the x axis direction) and rotational motion (about the x axis) via rotation of one or more rod engagers 400, 401 in the event of rod 115 being contaminated with lubricants such as oil, water and the like.

The invention claimed is:

1. A drill rod gripping apparatus to grip and impart rotational motion to a drill rod comprising:

a frame having a front end and a rear end spaced apart from the front end in a direction of a longitudinal axis corresponding to an axis of a drill rod when mounted at the apparatus;

a sled mounted at the frame via at least one support configured to allow axial movement of the sled relative to the frame, the at least one support including a pair of shafts mounted at and extending between the front end and rear end of the frame, the sled including a pair of sleeves, each sleeve being arranged to slide over a respective shaft such that sled is suspended in a floating relationship with respect to frame;

a first and second jaw mounted to move to and from each other;

at least one mount to mount at least one of the first and second jaws, such that at least one of the first and second jaws is configured to move across the sled in a non-pivoting sideways linear motion in a direction transverse or perpendicular to the longitudinal axis relative to the other jaw to engage the drill rod from either side; and a plurality of rod engagers mounted at each of the first and second jaws, at least one of the engagers being rotatably driven by a drive actuator, wherein at least one of the rod engagers includes an abrasive surface to increase frictional force between the drill rod and the at least one rod engager.

2. The apparatus as claimed in claim 1, wherein at least one mount includes tongue and groove arrangements.

3. The apparatus as claimed in claim 1, further comprising a drive mechanism having a drive actuator to drive the sideways linear motion of at least one of the first and second jaws.

4. The apparatus as claimed in claim 3, wherein the drive mechanism includes a rack and pinion arrangement driven by the drive actuator.

5. The apparatus as claimed in claim 1, further comprising an actuator arm pivotally mounted at one end to the frame and at a further end to a feed frame of a drill rig.

6. The apparatus as claimed in claim 1, further comprising a respective drive actuator mounted at the first and second jaws to drive at least one engager at each respective first and second jaws.

7. The apparatus as claimed in claim 6, wherein the engagers comprise two rollers mounted respectively at each of the first and second jaws.

8. The apparatus as claimed in claim 7, wherein the abrasive surface is provided at the two rollers mounted at either of the first or second jaws.

9. The apparatus as claimed in claim 1, wherein the abrasive surface is formed as a coating at the at least one engager.

10. The apparatus as claimed in claim 9, wherein the coating includes granular particles embedded therein.

11. The apparatus as claimed in claim 10, wherein the granular particles are selected from a group of diamond; silicon; zircon; tungsten; a carbide; tungsten carbide; carborundum; cubic boron nitride; diamond; glass; a ceramic; corundum; quartz; titanium; a polycrystalline diamond composite; natural diamond and a combination thereof.

12. The apparatus as claimed in claim 10, wherein the granular particles have an average particle diameter of between 200 to 800 μm.

13. The apparatus as claimed in claim 10, wherein the abrasive surface has a P-grade of between P24 to P60 according to the European Federation of European Producers of Abrasives (FEPA) international standard.

14. A drill rig arranged to feed rods to and from a drill string comprising:

a feed frame;

a rotation unit mounted at the feed frame arranged to provide rotational drive to the drill string;

a rod holder arranged to mount an end region of the drill string;

a gripping apparatus including a frame having a front end and a rear end spaced apart from the front end in a direction of a longitudinal axis corresponding to an axis of a drill rod when mounted at the apparatus, a sled mounted at the frame via at least one support configured to allow axial movement of the sled relative to the frame, the at least one support including a pair of shafts mounted at and extending between the front end and rear end of the frame, the sled including a pair of sleeves, each sleeve being arranged to slide over a respective shaft such that sled is suspended in a floating relationship with respect to frame; a first and second jaw mounted to move to and from each other, at least one mount to mount at least one of the first and second jaws, such that at least one of the first and second jaws is configured to move across the sled in a non-pivoting sideways linear motion in a direction transverse or perpendicular to the longitudinal axis relative to the other jaw to engage the drill rod from either side, and a plurality of rod engagers mounted at each of the first and second jaws, at least one of the engagers being rotatably driven by a drive actuator, wherein at least one of the rod engagers includes an abrasive surface to increase frictional force between the drill rod and the at least one rod engager; and a transporter mounting the gripping apparatus to the feed frame to transport the gripping apparatus from a rod collection position to a rod coupling position at the drill rig such that a rod is aligned axially with the drill string at the rod coupling position.

* * * * *